US010735870B2

(12) United States Patent
Ballande et al.

(10) Patent No.: US 10,735,870 B2
(45) Date of Patent: Aug. 4, 2020

(54) HEARING ASSISTANCE SYSTEM

(71) Applicant: Sonova AG, Staefa (CH)

(72) Inventors: William Ballande, Fribourg (CH); Timothée Jost, Auvernier (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/086,356

(22) PCT Filed: Apr. 7, 2016

(86) PCT No.: PCT/EP2016/057614

§ 371 (c)(1),
(2) Date: Sep. 19, 2018

(87) PCT Pub. No.: WO2017/174136

PCT Pub. Date: Oct. 12, 2017

(65) Prior Publication Data

US 2019/0104371 A1 Apr. 4, 2019

(51) Int. Cl.
*H04R 3/00* (2006.01)
*H04R 25/00* (2006.01)

(52) U.S. Cl.
CPC ..... *H04R 25/505* (2013.01); *H04R 3/005* (2013.01); *H04R 25/405* (2013.01); *H04R 25/43* (2013.01);

(Continued)

(58) Field of Classification Search
CPC combination set(s) only.
See application file for complete search history.

(56) References Cited

U.S. PATENT DOCUMENTS 5,737,430 A * 4/1998 Widrow ..... H04R 25/407 381/312
2010/0111324 A1* 5/2010 Yeldener ..... H04M 9/082 381/92

(Continued)

FOREIGN PATENT DOCUMENTS

EP 2840807 A1 2/2015

OTHER PUBLICATIONS

Anastasios Alexandridis et al: "Capturing and Reproducing Spatial Audio based on a Circular Microphone Array", Journal of Electrical and Computer Engineering, vol. 45, No. 6, Jan. 1, 2013, pp. 1-16.

(Continued)

*Primary Examiner* — Amir H Etesam

(57) ABSTRACT

There is provided a system for providing hearing assistance to a user, comprising: a table microphone unit (10) for capturing audio signals from a speaker's voice, comprising a microphone arrangement (16) comprising at least three microphones (M1, M2, M3) arranged in a non-linear manner, a beamformer unit (48) comprising a plurality of beamformers (BF1, BF2, . . . ), wherein each beamformer is configured to generate an acoustic beam (B1, B2, . . . ) by beamforming processing of audio signals captured by a subset of the microphones in such a manner that the acoustic beam has a fixed direction, an audio signal analyzer unit (52) for analyzing the beams in order to determine at least one acoustic parameter for each acoustic beam, a beam selection unit (54) for selecting one of the acoustic beams as the presently active beam based on the values of the at least one acoustic parameter, an output unit (60) for providing an acoustic output stream (26), wherein the output unit is configured to provide, during stationary phases of the beam selection, the presently active beam as the output stream, and to provide, during a transition period starting upon switching of the beam selection from a first beam to a second beam, a mixture of the first and second beam with a time-variable weighting of the first and second beam as the output stream so as to enable a smooth transition from the first beam to the second beam during the transition period, a transmission unit (20) for transmitting an audio signal corresponding to the output stream via a wireless link (14); and a hearing assistance device (12) to be worn by the user, comprising a receiver unit (30) for receiving audio signals transmitted from the transmitter of the table microphone unit (Continued)

and an output transducer (40) for stimulation of the user's hearing according to the received audio signals.

17 Claims, 5 Drawing Sheets

(52) U.S. Cl.
CPC ..... *H04R 25/554* (2013.01); *H04R 2203/12* (2013.01); *H04R 2225/43* (2013.01); *H04R 2430/20* (2013.01)

(56) References Cited

U.S. PATENT DOCUMENTS

| | | | | |
|---|---|---|---|---|
| 2011/0038489 | A1 | 2/2011 | Visser et al. | |
| 2012/0020485 | A1 | 1/2012 | Visser et al. | |
| 2018/0176682 | A1* | 6/2018 | Goesnar ..... | H04R 3/005 |

OTHER PUBLICATIONS

International Search Report and Written Opinion of PCT/EP2016/057614; Filed Apr. 7, 2016; Applicant Sonova AG; dated Dec. 23, 2016, 13 pages.

* cited by examiner

HEARING ASSISTANCE SYSTEM

The invention relates to a system for providing hearing assistance to a user, comprising a table microphone unit for capturing audio signals from a speaker's voice and a hearing assistance device to be worn by the user comprising a receiver unit for receiving audio signals transmitted from a transmitter of the table microphone unit and an output transducer for stimulation of the user's hearing according to the received audio signals. Typically, the hearing assistance device is a hearing instrument or an auditory prosthesis.

For users of hearing assistance device, such as hearing instruments, the use of one or more remote microphones allows to increase the signal-to-noise ratio (SNR), which provides for improved speech understanding, especially in noisy environments.

A typical use situation may be in a cafeteria or at a restaurant where the hearing instrument user is confronted with multiple small groups of talkers. Similar situations may occur at work or at school, where colleagues and pupils/students often work in groups of a few persons, thereby creating a potentially noisy environment. For example, in classrooms the teacher may typically set up some groups of four or five pupils for working together. In such use cases, sound is usually captured by placing a remote microphone unit at the center of the group. Alternatively, an individual clip-on microphone ("lapel microphone") or a microphone to be worn around the user's neck at the chest could be given to each participant, but often not enough wireless microphones for each participant are available, and it may be generally not very attractive to have the need of managing a larger number of wireless devices.

Typically, current solutions offered by conferencing systems in order to capture the talkers' voices with good audio quality mostly reside in using an omnidirectional sound capturing characteristic and applying strong noise cancelling. Examples of such systems are a wireless handheld microphone unit sold by the company Phonak Communications AG under the designation "Roger Pen", which has an omnidirectional conference mode when the microphone unit is lying on a table, and a table microphone unit sold by Phonak Communications AG under the designation "Roger Table Mic", which has a single omnidirectional microphone but offers the possibility to include two or more devices in a multi talker network (MTN).

An alternative approach is to use a microphone unit which has a directional characteristic in order to "point" toward the signal of interest; for example, the "Roger Pen" microphone unit is also provided, in addition to the omnidirectional table mode, with a directional reporter mode.

Noise cancelling algorithms used in omnidirectional conferencing systems to enhance speech quality tend to destroy part of the speech cues necessary for the listener, so that speech understanding actually may be compromised by the noise cancelling. Further, in situations with multiple groups of talkers, unwanted speech (i.e. speech coming from the adjacent group) may not be considered as noise by the noise cancelling algorithm and may be transmitted to the listener, which likewise may compromise understanding of the speech of interest.

Further, omnidirectional microphones may capture significant reverberation in case of rooms having difficult acoustics, thereby potentially lowering speech intelligibility.

Using a directional microphone may be inconvenient in case that the direction of the preferred audio source/talker is variable in time.

US 2010/0324890 A1 relates to an audio conferencing system, wherein an audio stream is selected from a plurality of audio streams provided by a plurality of microphones, wherein each audio stream is awarded a certain score representative of its usefulness for the listener, and wherein the stream having the highest score is selected as the presently active stream. The microphones may be omnidirectional. It is mentioned in the prior art discussion that audio streams to be selected may be the outputs of beam formers; it is also mentioned that there are systems utilizing a fixed beamformer followed by a stream selection subsystem.

EP 1 423 988 B2 relates to beamforming using an oversampled filter bank, wherein the direction of the beam is selected according to voice activity detection (VAD) and/or SNR.

US 2013/0195296 A1 relates to a hearing aid comprising a beamformer which is switched between a forward direction and a rearward direction depending on the SNR of the respective beam.

WO 2009/034524 A1 relates to a hearing instrument using an adjustable combination of a forward acoustic beam and a rearward acoustic beam, wherein the adjustment is triggered by VAD.

U.S. Pat. No. 6,041,127 relates to a beamformer which is steerable in three dimensions by processing of audio signals from a microphone array.

US 2008/0262849 A1 relates to a voice control system comprising an acoustic beamformer which is steered according to the position of a speaker, which is determined according to a control signal emitted by a mobile device utilized by the user.

WO 97/48252 A1 relates to a video conferencing system wherein the direction of arrival of a speech signal is estimated in order to direct a video camera towards the respective speaker.

WO 2005/048648 A2 relates to a hearing instrument comprising a beamformer utilizing audio signals from a first microphone embedded in a first structure and a second microphone embedded in a second structure, wherein the first and second structure are freely movable relative to each other.

It is an object of the invention to provide for a hearing assistance system comprising a microphone unit which is convenient to handle and which provides for good speech understanding even when used with groups of multiple talkers. It is a further object to provide for a corresponding hearing assistance method.

According to the invention these objects are achieved by a system as defined in the claims.

The invention is beneficial in that, by providing for a plurality of acoustic beams having a fixed direction, with one of the acoustic beams being selected as the presently active beam based on the values of at least one acoustic parameter of the beam, and by providing, during a transition period starting upon switching of the beam selection from a first beam to a second beam, a mixture of the first and second beam with a time-variable weighting of the first and second beam as an output stream to the wireless transmitter of the table microphone unit, typical drawbacks of omnidirectional systems, such as high reverberation, capturing of unwanted speech and reduced speech understanding due to the need for high noise cancelling, may be avoided, while there is no need for manual adjustment of acoustic beam directions by the user; further, loss of speech portions or unpleasant hearing impressions resulting from hard switching between beam directions can be avoided.

Preferred embodiments of the invention are defined in the dependent claims.

Hereinafter, examples of the invention will be illustrated by reference to the attached drawings, wherein.

Figure 1:
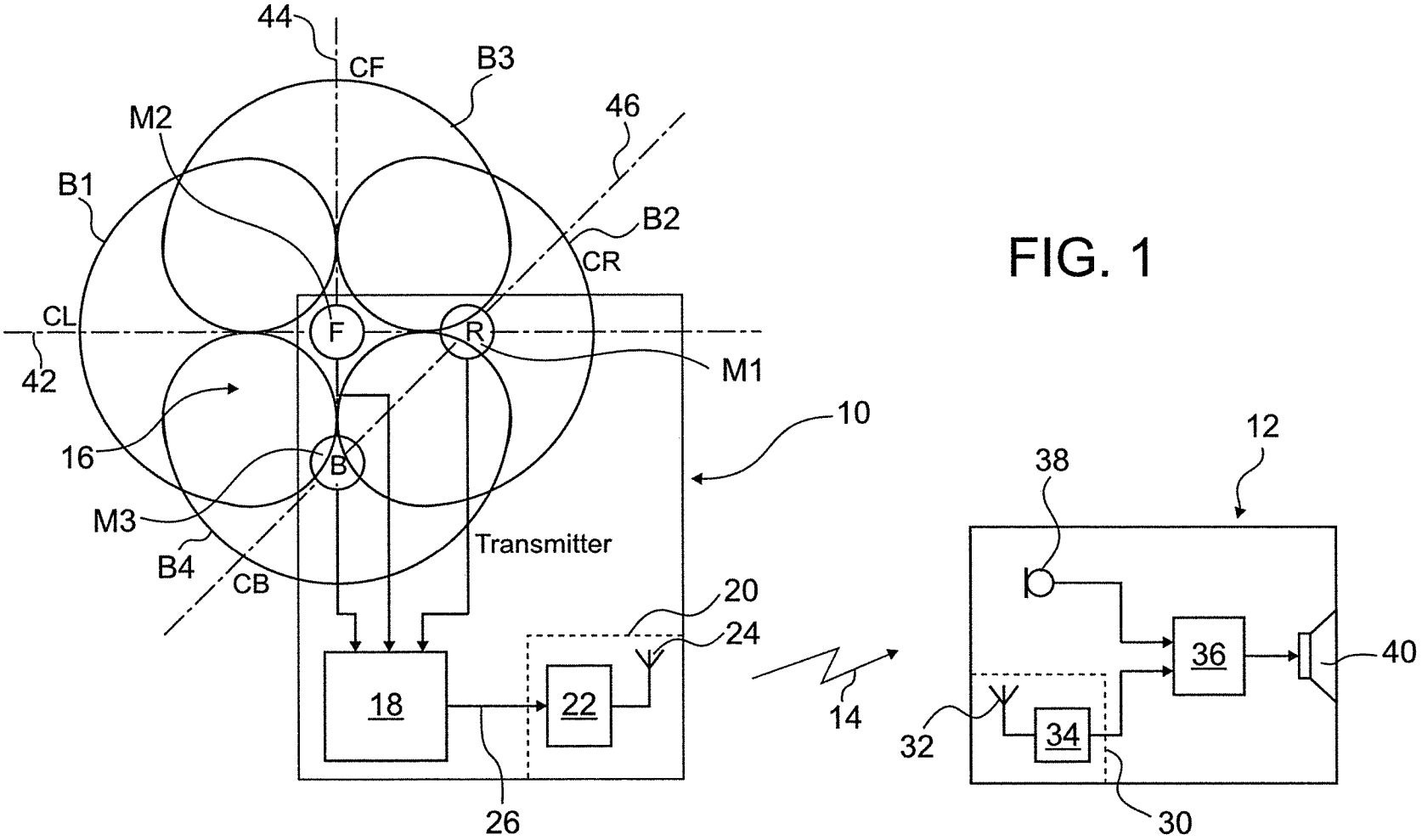
FIG. 1 is a schematic representation of an example of a hearing assistance system according to the invention.
Figure 7:
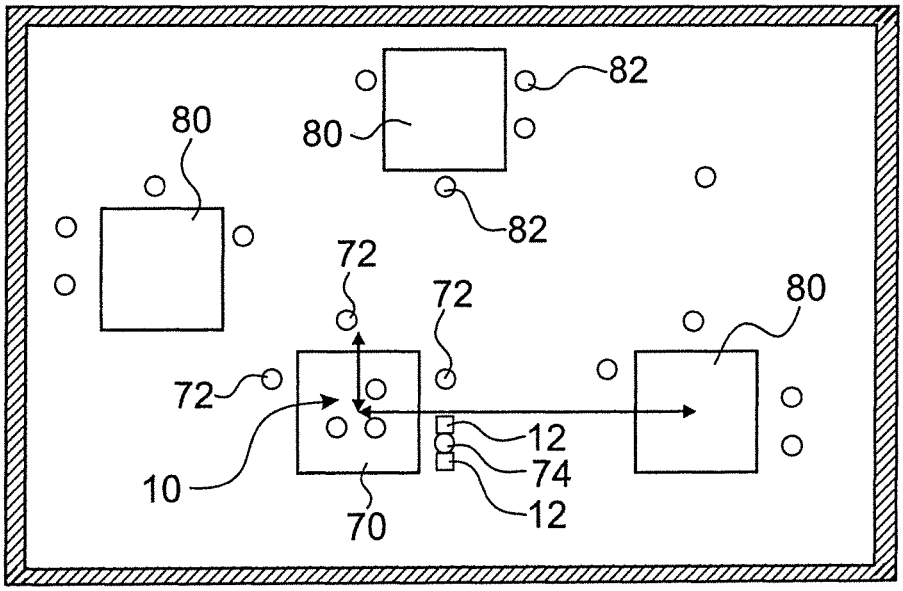
FIG. 7 is an illustration of a typical use situation of an example of a hearing assistance system according to the invention.

FIG. 1 is a schematic representation of an example of a hearing assistance system according to the invention, comprising a table microphone unit 10 for capturing audio signals from a plurality of persons sitting around a table and at least one hearing assistance device 12 which is worn by a listener and which receives audio signals from the table microphone unit 10 via a wireless audio link 14. FIG. 7 illustrates a typical use situation such system, wherein the table microphone unit 10 is placed on a table 70 surrounded by a plurality of tables 80, with a plurality of persons 72, 82 being distributed around the tables 70, 80, and wherein a listener 74 wearing a hearing assistance device 12 likewise is located at the table 70.

The table microphone unit 10 comprises a microphone arrangement 16 for capturing audio signals from speakers 72 located close to the table microphone unit 10, an audio signal processing unit 18 for processing the captured audio signals and a transmission unit 20 comprising a transmitter 22 and an antenna 24 for transmitting an output audio signal stream 26 provided by the audio signal processing unit 18 via the wireless link 14 to the hearing assistance device 12.

The hearing assistance device 12 comprises a receiver unit 30 including an antenna 32 and a receiver 34 for receiving the audio signals transmitted via the wireless link 14 and for supplying a corresponding audio stream to an audio signal processing unit 36 which typically also receives an audio input from a microphone arrangement 38. The audio signal processing unit 36 generates an audio output which is supplied to an output transducer 40 for stimulating the user's hearing, such as a loudspeaker. According to one example, the hearing assistance device 12 may be a hearing instrument, such as a hearing aid, or an auditory prosthesis, such as a cochlear implant. According to another example, the hearing assistance device 12 may be a wireless earbud or a wireless headset. Typically, the hearing assistance system comprises a plurality of hearing assistance devices 12 which may be grouped in pairs so as to implement binaural arrangements for one or more listeners, wherein each listener wears two of the devices 12.

Usually, the wireless link 14 is a digital link which typically uses carrier frequencies in the 2.4 MHz ISM band. The wireless link 14 may use a standard protocol, such as a Bluetooth protocol, in particular a Bluetooth Low Energy protocol, or it may use a proprietary protocol.

The microphone arrangement 16 of the table microphone unit 10 comprises at least three microphones M1, M2 and M3 which are arranged in a non-linear manner (i.e. which are not arranged on a straight line) in order to enable the formation of at least two acoustic beams having directions which are angled with regard to each other. In the example of FIG. 1, the microphone arrangement comprises three microphones which are arranged in an essentially L-shaped configuration, i.e. the axis 42 defined by the microphones M1 and M2 is essentially perpendicular to the axis 44 defined by the microphones M2 and M3.

Figure 2:
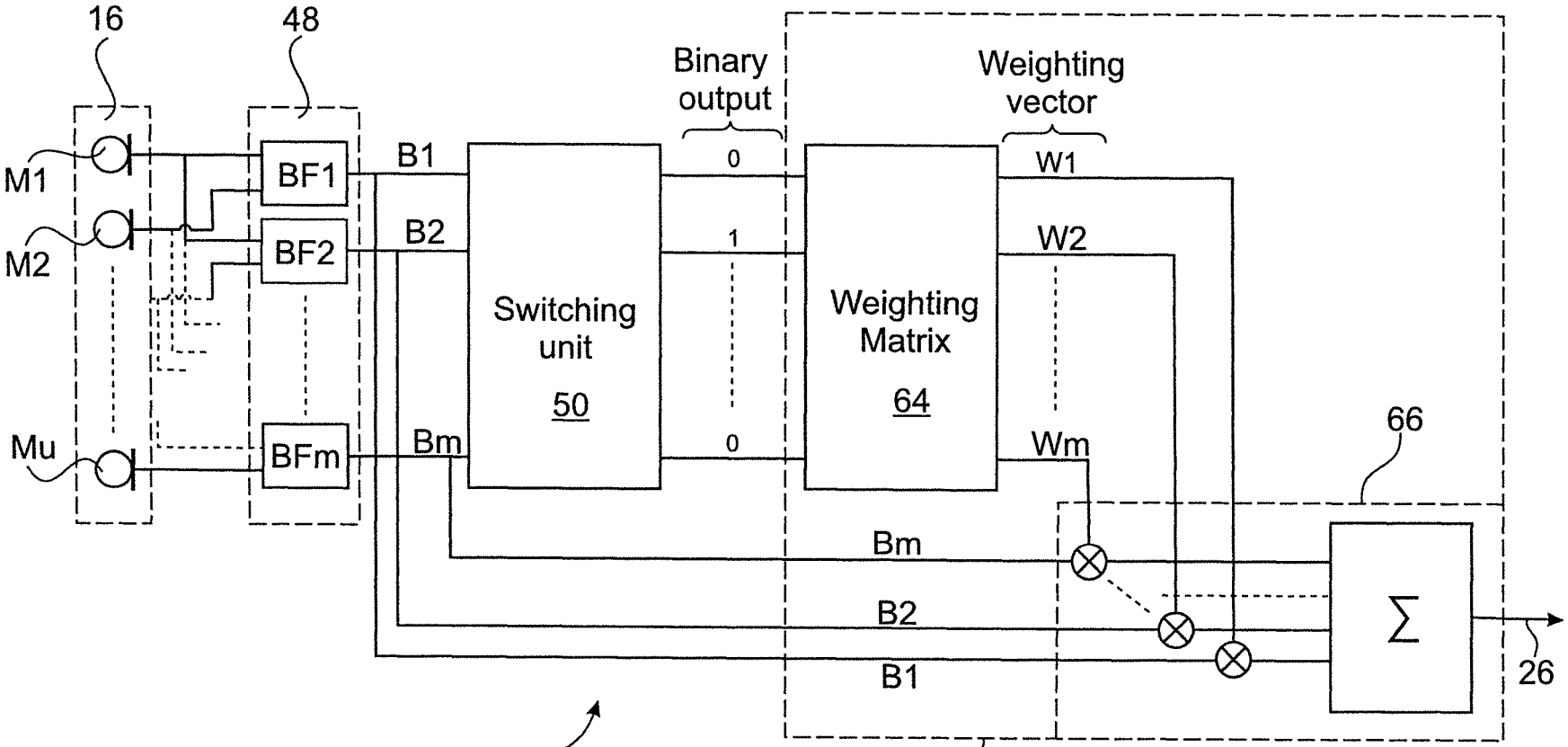
FIG. 2 is a block diagram of the signal processing in a microphone unit of an example of a system according to the invention.

In FIG. 2 an example of a block diagram of the audio signal processing in a table microphone unit, like the table microphone unit 10 of FIG. 1, is shown. The audio signals captured by the microphone arrangement 16 are supplied to a beamformer unit 48 comprising a plurality of beamformers BF1, BF2, . . . . The microphones (such as the microphones M1, M2 and M3) of the microphone arrangement 16 are grouped into different pairs of microphones, wherein at least one separate beamformer BF1, BF2, . . . is associated with each pair of microphones, wherein each beamformer BF1, BF2, . . . generates an output signal B1, B2, . . . which corresponds to an acoustic beam, wherein the beamforming in the beam former units BF1, BF2, . . . occurs in such a manner that the direction of each acoustic beam is different from the direction of the other acoustic beams. Typically, two beamformers are associated with each pair of microphones.

Figure 5:
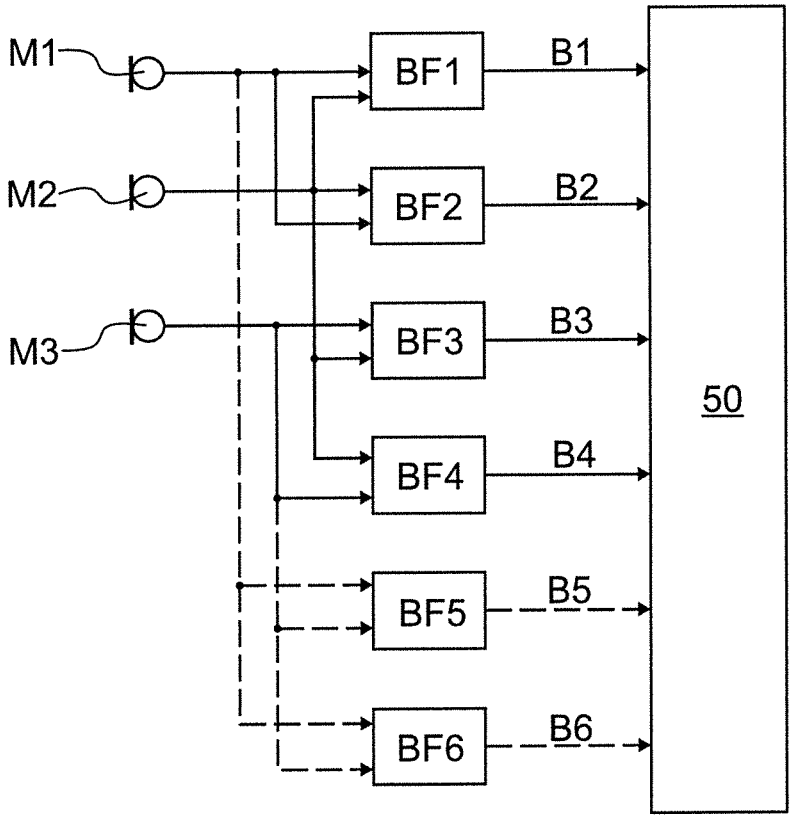
FIG. 5 is an example of a block diagram of the beamforming part of the block diagram of FIG. 2 when applied to a triangular arrangement of three microphones as shown in FIG. 1.

In the example of FIG. 1, the microphones M1, M2 and M3 are grouped to form two different pairs, namely a first pair formed by the microphones M1, M2 and a second pair formed by the microphones M2 and M3, wherein, as illustrated in FIG. 5, for each pair two separate beamformers are provided so as to generate, for each of these two microphone pairs, two different beams, wherein these beams preferably are oriented essentially on the axes 42, 44 defined by the respective pair of microphones, preferably within 15 degrees (i.e. the orientation of the beam does not deviate by more than 15 degrees from the respective axis), and wherein the two beams are essentially antiparallel (the beams preferably form an angle within 165 to 195 degrees relative to each other), thereby creating four different beams B1, B2, B3 and B4. As illustrated in FIG. 1, the beams B1 and B2 may be oriented essentially along the axis 42 defined by the microphones M1 and M2 and are antiparallel with regard to each other, and the beams B3 and B4 may be oriented substantially along the axis 44 defined by the microphones M2 and M3 and are essentially antiparallel with regard to each other.

Typically, the beamformers BF1, BF2, . . . operate in a "fixed beam mode" wherein the direction of the beam generated by the respective beam former unit is fixed, i.e. constant in time.

According to one example, the acoustic beams may be generated by an adaptive beamformer. In that case the beams are still focused in their preferred direction but the "nulls" of the beams are variable in time, depending on the result of an analysis of the audio signals captured by the microphone arrangement 16. The said "nulls" are typically steered toward the currently higher source of noise.

Figure 3:
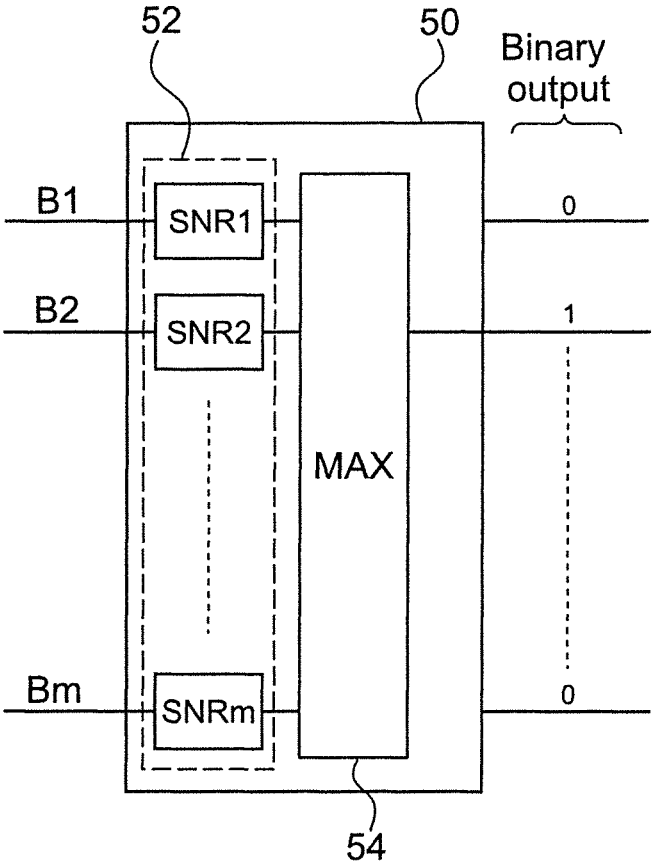
FIG. 3 is a block diagram of an example of the beam selection unit of FIG. 2.

The beams B1, B2, . . . generated by the beamformers BF1, BF2, . . . are supplied to a beam switching unit 50 which selects, at least when operating in a "single beam mode", one of the beams B1, B2, . . . as the presently active beam, based on the values of at least one acoustic parameter which is regularly determined for each of the acoustic beams B1, B2, . . . . To this end, the beam switching unit 50 comprises an audio signal analyzer unit 52 for determining such at least one acoustic parameter and a beam selection unit 54 for selecting one of the beams as the presently active beam based on the input provided by the audio signal analyzer unit 52 (see FIG. 3). In the example of FIG. 3, the audio signal analyzer unit 52 comprises a SNR detector SNR1, SNR2, . . . for each of the beams B1, B2, . . . which provides the SNR of each beam as an input to the beam selection unit 54. In the example of FIG. 3, the beam selection unit 54 selects that beam as the presently active beam which has the highest SNR and provides an appropriate output which preferably is binary, i.e. the output of the selection unit 54 is "1" for the presently active beam and it is "0" for the other beams.

The output of the beam switching unit 50 is supplied to an output unit 60 which generates an acoustic output stream 26 from the acoustic beams B1, B2, . . . of the beamformers BF1, BF2, . . . , which output stream is supplied to the transmission unit 20 for being transmitted via the wireless link 14 to the hearing assistance device 12.

The output unit 60 comprises a weighting unit 64 which receives the output from the beam switching unit 50 in order to output a weighting vector as a function of the input; the weighting vector includes a certain weight component W1, W2, . . . for each of the beams B1, B2, . . . . The weighting vector is supplied as input to an adding unit 66 which adds the beams B1, B2, . . . according to the respective weight component W1, W2, . . . of the weighting vector; the accordingly weighted sum is output by the adder unit 66 as the audio output stream 26.

The output unit 60 may operate at least in a "single beam mode" wherein, during stationary phases of the beam selection by the switching unit 50, the presently active beam (in the example of FIG. 2 this is the beam B2) is provided as the output stream 26, i.e. the weighting unit 64 in this case provides for a weighting vector in which all weight components, except for the component W2 for the beam B2, would be "1", while the component W2 would be "1". "Stationary phase" in this respect means that the presently active beam already has been the presently active beam at least for a time interval longer than the predefined length of a transition period, i.e. a stationary phase starts once the time interval having passed since the last switching of the presently active beam is longer than the predefined length of the transition period; typically, the length of the transition period is set to be from 100 to 2000 ms. Thus, during stationary phases of the beam selection, one of the fixed beams formed by the beamformers BF1, BF2, . . . is selected as the sole output stream 26 of the table microphone unit 10.

During transition periods, i.e. during times when the time interval having passed since the last switching of the presently active beam is still shorter than the predetermined length of the transition period, the output unit 60 provides a mixture of the "old beam" and the "new beam" with a time-variable weighting of the old beam and the new beam as the output stream 26, so as to enable a smooth transition from the old beam to the new beam during the transition period (it is to be understood that a transition period starts upon switching of the beam selection by the beam switching unit 50 from the old beam to the new beam).

Figure 4:
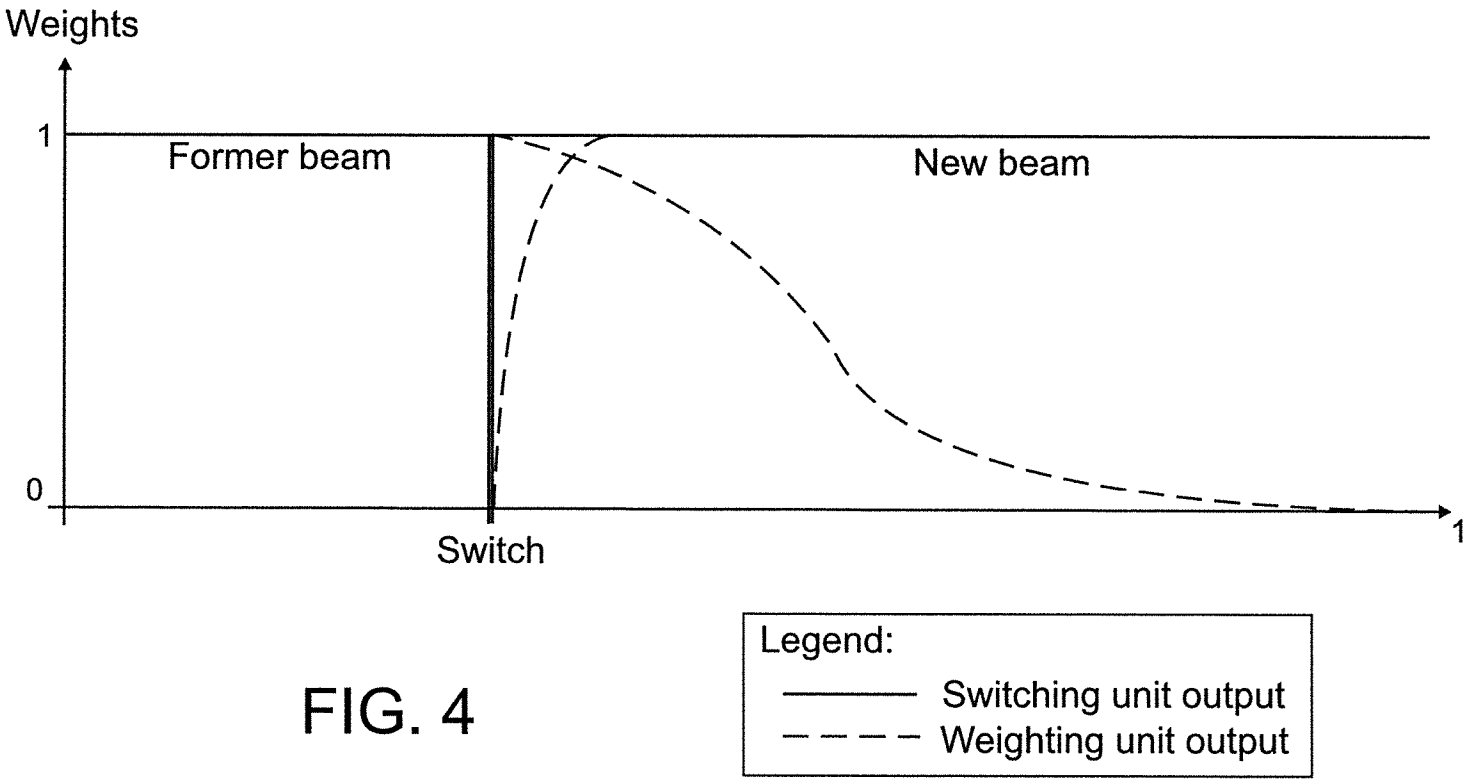
FIG. 4 is an example of the weighting of an old beam and a new beam during a transition period.

In the example of FIG. 2 such smooth transition can be implemented by configuring the weighting unit 64 such that the weighting vector changes during the transition period as a monotonous function of time so as to fade in the new beam and to fade out the old beam. As illustrated in FIG. 4, during the transition period the weight of the new beam is monotonously increased from "0" to "1", and the weight of the old beam is monotonously reduced from "1" to "0". Preferably, the fade-in time of the new beam is shorter than the fade-out time of the old beam. For example, the fade-in time may be from 1 to 50 ms and the fade-out time may be from 100 to 2000 ms. A typical value of the fade-in time of the new beam is 10 ms and a typical value of the fade-out time of the old beam is 500 ms.

Alternatively or in addition to the use of the SNR as the relevant acoustic parameter for selection of the presently active beam the switching unit 50 may use the voice activity status of the respective beam, as detected by a voice activity detector (VAD), i.e. in this case the beam switching unit 50 would include a VAD for each beam B1, B2, . . . .

According to one embodiment, the beamformers BF1, BF2 may operate not only in a "fixed beam mode" but alternatively may operate in a "variable beam mode" in which the beamformers BF1, BF2, . . . generate a steerable beam having a variable direction controlled according to a result of an analysis of the audio signals captured by the pair of microphones associated with the respective beamformer. This allows to optimize the SNR, for example, in situations in which a speaker is located in directions in-between two of the fixed beams.

According to another example, the output unit 60 may be configured to operate not only in the above discussed "single beam mode", but it alternatively also may operate in a "multi-beam mode" in which the output unit 60 not only during transition periods but also during stationary periods of the beam selection provided for a weighted mixture of at least two of the beams as the output stream 26. According to one example, the weights of the beams in the multi-beam mode may be determined as a function of the SNR of the respective beam. Thereby multiple beams having a similarly high SNRs may contribute to the output stream 26. According to one example, the output unit 60 may decide to operate in the multi-beam mode rather than in the single-beam mode if the difference of the SNR of the two beams with the highest SNR is below a predetermined threshold value (which indicates that there are two equally useful beams). According to another example, the output unit 60 may decide to operate in the multi-beam mode if it is detected by analyzing the audio signals captured by the microphone arrangement 16 that the audio signals captured by the microphones contributing to at least two of the beams contain valuable speech. Typically, this can be done with a VAD or with the absolute SNR values (for example, the output unit 60 may decide to operate in the multi-beam mode in case that the SNR of each of the two beams with the highest SNR is above a predetermined threshold value).

The audio signal processing unit 18 of the table microphone unit 10 may include, in addition to the beamformers BF1, BF2, . . . , further audio signal processing features, such as application of a gain model and/or noise cancellers to the respective beam provided by the beamformers BF1, BF2, . . . , prior to supplying the respective beam to the output unit 60 (or to the switching unit 50), thereby implementing a full audio path.

As a variant of the beamforming scheme of FIG. 5 discussed so far it may be beneficial to form also two antiparallel beams from a combination of the microphones M1 and M3, as shown in dashed lines in FIG. 5, which would require two additional beamformers BF5 and BF6, resulting in two additional beams B5 and B6, which preferably would be oriented along an axis 46 defined by the microphones M1 and M3 (see FIG. 1).

Figure 6:
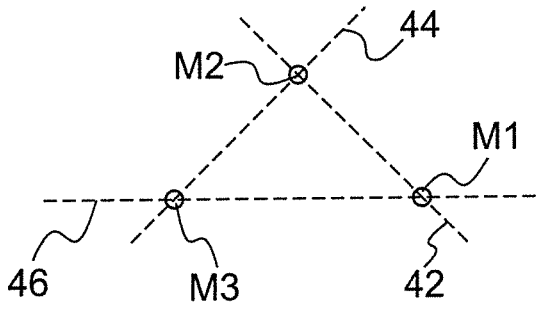
FIG. 6 is a schematic representation of an equilateral triangular arrangement of three microphones.

Such beamforming scheme could be applied also to different microphone configurations, such as an equilateral triangular configuration as illustrated as in FIG. 6, wherein the axis of adjacent pairs of microphones intersect at an angle of 60 degrees, wherein the beams then preferably are oriented along these axis 42, 44, 46, with two antiparallel beams being produced for each pair of microphones.

It is to be understood that, while preferably the beams are oriented along the axes defined by the microphone pairs, the beams in general could be off-axis. This also implies that more than 2 microphones could be considered in each beamformer BF1, BF2, . . . . For example, 4 perpendicular or opposite beams such as illustrated in FIG. 1 could be created in the equilateral triangular configuration as illustrated as in FIG. 6. Also, microphones having a directional characteristic may be used instead of or in combination with omnidirectional microphones.

In some examples, there may be more than three microphones in order to even more equally cover the entire angular range by selecting one fixed beam out of a plurality of fixed beams during the stationary periods.

The invention claimed is:

1. A system for providing hearing assistance to a user, the system comprising:

a table microphone unit for capturing audio signals, the table microphone unit comprising a microphone arrangement comprising at least three microphones arranged in a non-linear manner;

a beamformer unit comprising a plurality of beamformers, wherein each beamformer is configured to generate an acoustic beam;

an audio signal analyzer unit for analyzing the plurality of beams to determine at least one acoustic parameter for each of the acoustic beams;

a beam selection unit for selecting one of the acoustic beams as an active beam based on the at least one acoustic parameter;

an output unit for providing an acoustic output stream, wherein the output unit is configured to provide, during stationary phases of the beam selection, the active beam as the output stream, and to provide, during a transition period starting upon switching of the beam selection from a first beam to a second beam, a mixture of the first and second beam with a time-variable weighting of the first and second beams as the output stream so as to enable a smooth transition from the first beam to the second beam during the transition period, a transmission unit for transmitting an audio signal corresponding to the output stream via a wireless link; and a hearing assistance device comprising a receiver unit for receiving audio signals transmitted from the transmitter of the table microphone unit and an output transducer for providing audio based on the received audio signals.

2. The system of claim 1, wherein the direction of each acoustic beam is different from the directions of the other acoustic beams.

3. The system of claim 2, wherein the microphones have an omnidirectional characteristic.

4. The system of claim 3, wherein the direction of each acoustic beam generated from the audio signals of one of the pairs of the microphones is oriented within ±15 degrees on an axis defined by that pair of microphones.

5. The system of claim 4, wherein a pair of the beamformers is provided for each of the pairs of microphones, and wherein each pair of beamformers is configured to produce two beams which are antiparallel with regard to each other within ±15 degrees.

6. The system of claim 4, wherein the microphone arrangement comprises three microphones that are arranged in an equilateral triangular configuration, wherein the first and second microphones define a first axis, the second and third microphones define a second axis, and the first and third microphones define a third axis, wherein the axes pairwise intersect at an angles of within 50 to 70 degrees, wherein a first pair of microphones is formed by the first and second microphones for a first and second beamformer, a second pair of microphones is formed by the second and third microphones for a third and fourth beamformer, and a third pair of microphones is formed by the first and third microphone for a fifth and sixth beamformer, wherein the beams formed by the first and second beamformer are antiparallel with regard to each other within ±15 degrees and are oriented along the first axis within ±15 degrees, wherein the beams formed by the third and fourth beamformer are antiparallel with regard to each other within ±15 degrees and are oriented along the second axis within ±15 degrees, and wherein the beams formed by the fifth and sixth beamformer are antiparallel with regard to each other within ±15 degrees and are oriented along the third axis within ±15 degrees.

7. The system of claim 1, wherein the at least one acoustic parameter comprises a signal-to-noise ratio ("SNR") of a respective beam.

8. The system of claim 1, wherein each beamformer is configured to generate the acoustic beam with variable beam width.

9. The system of claim 1, wherein the output unit comprises a weighting unit, wherein the beam selection unit is configured to provide for an output concerning the selected beam, which output is supplied as input to the weighting unit, wherein the weighting unit is configured to output a weighting vector as a function of the input, and wherein the weighting vector changes during the transition period as a monotonous function of time so as to fade in the second beam and to fade out the first beam.

10. A method for providing hearing assistance to a user, the method comprising:

capturing audio signals using a table microphone unit;

generating a plurality of acoustic beams by beamforming audio signals captured by a subset of microphones in the table microphone unit;

selecting one of the acoustic beams as an active beam based on an acoustic parameter, providing an acoustic output stream, wherein, during a stationary period of the beam selection, the active beam is provided as the output stream, and wherein, during a transition period starting upon switching of the beam selection from a first beam to a second beam, a mixture of the first and second beam with a time-variable weighting of the first and second beam is provided as the output stream so as to enable a smooth transition from the first beam to the second beam during the transition period;

transmitting, by a transmission unit of the table microphone unit, an audio signal corresponding to the output stream via a wireless link;

receiving, by a receiver unit of a hearing assistance device, the audio signal transmitted from the transmitter of the table microphone unit; and providing audio, by an output transducer of the hearing assistance device, based on the received audio signal.

11. The method of claim 10, wherein the acoustic parameter is a signal-to-noise ratio ("SNR") of a respective acoustic beam.

12. The method of claim 10, wherein the microphones comprise three microphones that are arranged in an equilateral triangular configuration, wherein the first and second microphone define a first axis, the second and third microphone define a second axis, and the first and third microphone define a third axis, wherein the axes pairwise intersect at an angles of within 50 to 70 degrees, wherein a first pair of microphones is formed by the first and second microphone for a first and second beamformer, a second pair of microphones is formed by the second and third microphone for a third and fourth beamformer, and a third pair of microphones is formed by the first and third microphone for a fifth and sixth beamformer, wherein the beams formed by the first and second beamformer are antiparallel with regard to each other within ±15 degrees and are oriented along the first axis within ±15 degrees, wherein the beams formed by the third and fourth beamformer are antiparallel with regard to each other within ±15 degrees and are oriented along the second axis within ±15 degrees, and wherein the beams formed by the fifth and sixth beamformer are antiparallel with regard to each other within ±15 degrees and are oriented along the third axis within ±15 degrees.

13. The method of claim 10, a weighting changes of the audio signals during a transition period as a monotonous function of time so as to fade in a second beam and to fade out a first beam.

14. A non-transitory computer-readable medium storing instructions that when executed by a processor cause a processor to perform operations, the operations comprising:

capturing audio signals using a table microphone unit;

generating a plurality of acoustic beams by beamforming audio signals captured by a subset of microphones in the table microphone unit;

selecting one of the acoustic beams as an active beam based on an acoustic parameter, providing an acoustic output stream, wherein, during a stationary period of the beam selection, the active beam is provided as the output stream, and wherein, during a transition period starting upon switching of the beam selection from a first beam to a second beam, a mixture of the first and second beam with a time-variable weighting of the first and second beam is provided as the output stream so as to enable a smooth transition from the first beam to the second beam during the transition period;

transmitting, by a transmission unit of the table microphone unit, an audio signal corresponding to the output stream via a wireless link; and receiving, by a receiver unit of a hearing assistance device, the audio signal transmitted from the transmitter of the table microphone unit and providing audio, by an output transducer of the hearing assistance device, based on the received audio signal.

15. The non-transitory computer-readable medium of claim 14, wherein the acoustic parameter is a signal-to-noise ratio ("SNR") of a respective acoustic beam.

16. The non-transitory computer-readable medium of claim 14, wherein the microphones comprise three microphones that are arranged in an equilateral triangular configuration, wherein the first and second microphone define a first axis, the second and third microphone define a second axis, and the first and third microphone define a third axis, wherein the axes pairwise intersect at an angles of within 50 to 70 degrees, wherein a first pair of microphones is formed by the first and second microphone for a first and second beamformer, a second pair of microphones is formed by the second and third microphone for a third and fourth beamformer, and a third pair of microphones is formed by the first and third microphone for a fifth and sixth beamformer, wherein the beams formed by the first and second beamformer are antiparallel with regard to each other within ±15 degrees and are oriented along the first axis within ±15 degrees, wherein the beams formed by the third and fourth beamformer are antiparallel with regard to each other within ±15 degrees and are oriented along the second axis within ±15 degrees, and wherein the beams formed by the fifth and sixth beamformer are antiparallel with regard to each other within ±15 degrees and are oriented along the third axis within ±15 degrees.

17. The non-transitory computer-readable medium of claim 14, a weighting changes of the audio signals during a transition period as a monotonous function of time so as to fade in a second beam and to fade out a first beam.

* * * * *